US008147159B2

(12) United States Patent
Glesser et al.

(10) Patent No.: US 8,147,159 B2
(45) Date of Patent: Apr. 3, 2012

(54) WRITING INSTRUMENT WITH ROTATABLE HANDLES

(75) Inventors: Louis S. Glesser, Evergreen, CO (US); Eric G. Glesser, Golden, CO (US)

(73) Assignee: Spyderco, Inc., Golden, CO (US)

( * ) Notice: Subject to any disclaimer, the term of this patent is extended or adjusted under 35 U.S.C. 154(b) by 1098 days.

(21) Appl. No.: 11/947,059

(22) Filed: Nov. 29, 2007

(65) Prior Publication Data

US 2009/0142127 A1 Jun. 4, 2009

(51) Int. Cl.
*B43K 29/00* (2006.01)

(52) U.S. Cl. ..... 401/195; 401/114

(58) Field of Classification Search ..... 401/195, 401/99, 115, 117, 107, 108; 24/11 M, 11 P; 8/160, 168

See application file for complete search history.

(56) References Cited

U.S. PATENT DOCUMENTS

| | | | | |
|---|---|---|---|---|
| 3,407,021 | A * | 10/1968 | Mosch | 401/29 |
| 3,618,518 | A * | 11/1971 | Rigoni | 101/263 |
| 3,945,734 | A * | 3/1976 | Woodbridge | 401/198 |
| 4,067,947 | A | 1/1978 | Miori | |
| 4,149,812 | A | 4/1979 | Huffman, Jr. | |
| 4,261,103 | A | 4/1981 | Heck | |
| 4,330,937 | A | 5/1982 | Cope | |
| 4,364,174 | A | 12/1982 | De Asis | |
| D289,368 | S | 4/1987 | Mann | |
| 4,672,743 | A | 6/1987 | Grahm | |
| 4,738,558 | A | 4/1988 | Hiromori | |
| 4,815,881 | A * | 3/1989 | Chern | 401/52 |
| 5,061,104 | A | 10/1991 | Florjancic | |
| 5,115,571 | A * | 5/1992 | Mackin | 33/558.04 |
| 5,551,141 | A | 9/1996 | De'Ath et al. | |
| 5,678,939 | A | 10/1997 | Ross | |
| 5,694,692 | A | 12/1997 | Reinschreiber | |
| D389,185 | S | 1/1998 | O'Mara et al. | |
| D420,702 | S | 2/2000 | Chang | |
| 6,170,158 | B1 | 1/2001 | Daily | |
| 6,195,898 | B1 | 3/2001 | Lemisch | |
| 6,264,389 | B1 | 7/2001 | Ducharme | |

(Continued)

FOREIGN PATENT DOCUMENTS

CN 2335791 9/1999

OTHER PUBLICATIONS

"Kershaw or Spyderco ?? One of a Kind ~1600 Combo Serr", eBay website, Item No. 6587650374, printed Dec. 13, 2005, pp. 1-5.

(Continued)

*Primary Examiner* — David Walczak
(74) *Attorney, Agent, or Firm* — Sheridan Ross P.C.

(57) ABSTRACT

A hand-held instrument comprising a writing utensil and associated handles interconnected to each other to allow a user to selectively position the writing utensil in either an extended position of use or a closed position of storage, as well as a variety of positions there between. The writing utensil may take a variety of forms, and the handles may incorporate additional devices or tools. The rotation of the handles about the writing utensil allows a user to manipulate the handles in a variety of ways, similar to that of a "butterfly knife" or similar device comprising balisong style openings. In one aspect of the invention, the writing instrument may be used to perform moves or tricks as a novelty device to provide entertainment and enjoyment to a user.

19 Claims, 5 Drawing Sheets

U.S. PATENT DOCUMENTS

| | | | | |
|---|---|---|---|---|
| 6,331,087 | B1 | 12/2001 | Wang | |
| 6,464,419 | B1 | 10/2002 | Chan | |
| D487,494 | S | 3/2004 | Glesser | |
| 6,780,365 | B2 | 8/2004 | Goldbach | |
| 7,056,459 | B2 | 6/2006 | Park | |
| D526,682 | S | 8/2006 | Ortiz et al. | |
| 7,103,947 | B2 | 9/2006 | Sartor et al. | |
| D534,212 | S | 12/2006 | Chan | |
| 7,452,150 | B2 * | 11/2008 | Chan | 401/117 |
| 2005/0055835 | A1 | 3/2005 | Pardue et al. | |
| 2005/0145061 | A1 | 7/2005 | Ording et al. | |
| 2005/0217211 | A1 | 10/2005 | Py | |
| 2005/0223677 | A1 | 10/2005 | Py | |
| 2006/0073322 | A1 | 4/2006 | Donatti et al. | |
| 2006/0196055 | A1 | 9/2006 | Barcala | |
| 2009/0140456 | A1 | 6/2009 | Glesser et al. | |

OTHER PUBLICATIONS

Skipper Martin et al., Ape Entertainment Forums: My strange brain and the amazing "Bizarre Pen.", Ape Entertainment Forums, available at http://www.ape-entertainment.com/cgi-bin/ultimatebb.cgi?ubb=get_topic;f=81;t=000002;p=1#000000, Mar. 24, 2007, pp. 1-5.

First Office Action (including translation) for Chinese Patent Application No. 200810178632.1, issued Apr. 7, 2011.

Official Action for U.S. Appl. No. 12/247,643, mailed Nov. 23, 2011.

* cited by examiner

WRITING INSTRUMENT WITH ROTATABLE HANDLES

FIELD OF THE INVENTION

The present invention relates generally to writing instruments. More particularly, the invention relates to a writing instrument with rotatable handles for selectively storing and/or using the writing instrument.

BACKGROUND OF THE INVENTION

Writing instruments have been known in the art for a long time, in various styles and configurations, including pencils and pens for use by an individual on a surface such as paper. As writing instruments have developed, they have taken on a variety of different designs, profiles and shapes to accommodate different writing styles, and some designs allow a writing instrument to be collapsed or stored in at least one position so that the writing instrument is protected from damage when it is not in use. Along these lines, several prior art writing instruments are known which allow a writing utensil to be rotatably or pivotably attached to a casing or handle, which then allow the writing utensil to be positioned either away from the handle in a position of use, or enclosed within a handle in a position of storage.

However, prior art writing instruments of this type provide a writing utensil fixed to a single handle, and do not allow the writing utensil to be used in multiple positions respective to the handle. Furthermore, the casing or handle of these prior art devices are typically obtrusive to a user when attempting to use the writing instrument for writing. Therefore, according to the present invention, a device which comprises a writing utensil rotatably attached to a pair of handles which allow the writing utensil to be selectively positioned either away from the handles in a position of use, or enclosed by the handles in a position of storage, wherein both positions allow the writing instrument to be easily grasped by a user is disclosed. Furthermore, it is also desirable to allow the writing utensil to be used when the writing utensil is positioned in either a position of storage or use relative to the handles. Further, it is also desirable to provide a writing instrument that has a secondary purpose of providing entertainment to the user, and wherein a variety of tricks and movements can be performed by rotating a plurality of handles in a variety of different positions similar to a "butterfly" knife as shown and described in U.S. Pat. No. 6,195,898, which is incorporated herein in its entirety by reference.

These and other problems are solved by the present invention, which comprises a writing instrument including a writing component rotatably connected to two handles at a common point of rotation as described in greater detail herein.

SUMMARY OF THE INVENTION

It is thus an object of the present invention to provide a writing instrument comprising a writing utensil and associated handles interconnected to each other to allow a user to selectively position the writing utensil in either an extended position of use or a closed position of storage. It is a further object of the present invention that the writing utensil and associated handles be designed to use a minimum number of components, thus making the writing instrument inexpensive to manufacture, simplistic in design, and encompassing a variety of different embodiments.

Thus, in one aspect of the present invention, a writing instrument is provided which comprises a writing utensil rotatably connected to two handles, each of the handles rotatable about a fixed point proximate the non-writing end of the writing utensil and allowing the handles to be positioned in various ways relative to the writing utensil. In one position, the handles may be positioned adjacent one another with the writing utensil extended longitudinally away from the adjacent handles in a position of use. In another position, the handles may be positioned adjacent to the longitudinal length of the writing utensil, with the writing utensil at least partially enclosed between the handles in a position of storage. In this embodiment, the writing instrument may be used to write when the writing utensil is in either a position of use or a position of storage. In this embodiment, the writing utensil is partially exposed at the end of the writing utensil opposite the end comprising the attachment of the handles, thereby allowing the writing utensil to contact a writing utensil forward end despite the body of the writing utensil being stored between the handles of the writing instrument. The writing instrument according to this embodiment may be held by a user in one of two different positions, thereby accommodating individual preferences for grasping the writing instrument, In another aspect of the invention, the writing instrument may be used to write only when the writing utensil is in the extended position of use, and not used when the handles completely surround the writing utensil and protect the writing utensil when it is in a position of storage.

In another aspect of the invention, the writing instrument may be used to provide a source of enjoyment and entertainment to the user, wherein the rotation of the handles about the writing instrument may be used to perform a variety of manipulations, movements and tricks by quickly rotating the handles in a variety of different positions, similar to a "butterfly" knife.

Thus, in one particular aspect or embodiment of the present invention, a folding instrument is provided which generally comprises:

a writing utensil;

at least two handles rotatably interconnected to a first distal end of the writing utensil, the at least two handles further comprising recesses along a longitudinal length of the at least two handles for enclosing at least a portion of the writing utensil between the at least two handles in a first position;

wherein the at least two handles are independently rotatable about the first distal end of the writing utensil to allow the at least two handles to become positioned adjacent to each other in a second position with the writing utensil extended from the at least two handles in a position of use, and wherein each of the at least two handles can independently rotate around the point of interconnection at the distal end of the writing utensil.

According to another embodiment of the present invention, a folding tool is provided which generally comprises:

a first instrument;

at least two handles rotatably interconnected to a first distal end of the first instrument, the at least two handles further comprising recesses along a longitudinal length of the at least two handles for enclosing at least a portion of the first instrument between the at least two handles in a first position;

wherein either of the at least two handles further comprise a second instrument;

wherein the at least two handles are independently rotatable about the first distal end of the first instrument to allow the at least two handles to become positioned adjacent to each other in a second position with the first instrument extended from the at least two handles in a position of use, and wherein each of the at least two handles can independently rotate around the point of interconnection at the distal end of the first instrument.

The foldable instrument or tool according to various embodiments may further comprise a lead pencil, graphite pencil, mechanical pencil, mechanical eraser, pen, magic marker, eraser, mini digital caliper, map measuring wheel, ruler, LED, laser pointer, flashlight, nail, pivot, pick, compass, divider, trammel point, scribe, magnifier, telescope, glow sticks, reference devices, math tables, language tables, lists, a cellular device, a paging device, a remote control, a tape recorder, radio, brush, comb, file or a container.

The foldable instrument or tool according to various embodiments comprise at least two handles nearly frictionlessly rotatably interconnected to a distal end of a writing utensil. Further, in various embodiments, the handles have substantially the same size and shape. Moreover, in various embodiments, the handles rotate within the same plane.

The foldable instrument or tool according to various embodiments may be formed of a material comprising at least one of a plastic material, a synthetic material, a wood material, a bone material, a horn material, a stag material, a steel material, a stainless steel material, a brass material, an aluminum material, an aluminum alloy material, a composite material and a metallic material. Further, in various embodiments, the folding instrument or tool comprises a writing utensil comprised of a different material than the handles.

The drawings are not necessarily to scale.

DETAILED DESCRIPTION

Figure 1:
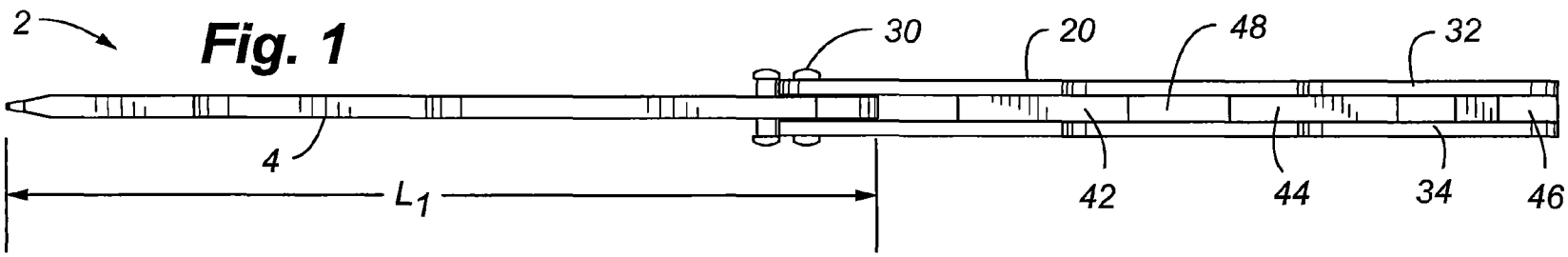
FIG. 1 is a top plan view of a writing instrument with rotatable handles shown in an open position, according to one embodiment of the invention.

As described in detail below, various embodiments of the present invention include a novel, collapsible writing instrument, comprising two handles rotatably connected to a utensil for writing, such as a pen or pencil. Referring now to the drawings, FIG. 1 represents one particular embodiment of the present invention and generally depicts a writing instrument 2 in a first open position with a writing utensil 4 available for use. In general, the writing instrument 2 comprises a writing utensil 4 rotatably connected to at least one handle portion 20. The at least one handle portion 20 is rotatable about the writing utensil 4 at writing utensil distal end 8 by a pin 30 or similar connection. The fixed point of rotation provided by pin 30 for the at least one handle portion 20 allows the rotation of the handle portion 20 about the writing utensil 4 to allow the at least one handle portion 20 to be placed adjacent to the longitudinal length $L_1$, of the writing utensil 4 in a closed position of storage, or placed away from the writing utensil 4 so as to be generally parallel to the direction of and extending away from the writing utensil 4 in an open position of use (as depicted in FIG. 1). The at least one handle portion 20 further comprises a first portion 32 and a second portion 34, which are partially joined to one another by pin 30 and spacer elements 42, 44 and 46, and may provide a general recess 48 therebetween for receiving the writing utensil 4 when the writing instrument 2 is in a closed position of storage.

Figure 2:
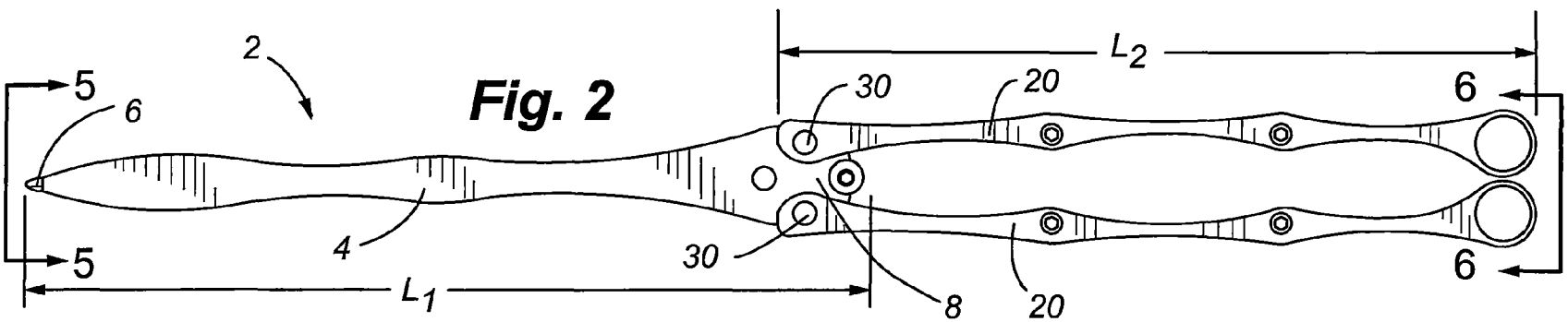
FIG. 2 is a front elevation view of the writing instrument of FIG. 1.
Figure 3:
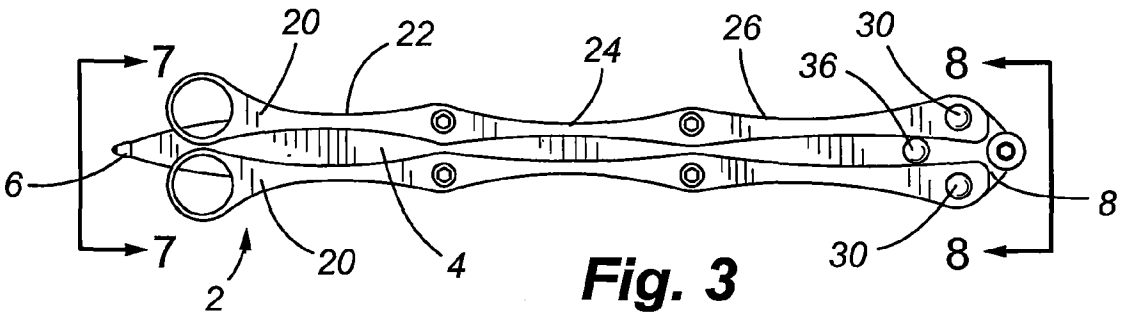
FIG. 3 is a front elevation view of the writing instrument of FIG. 1 shown in a closed position.

Referring now to FIG. 2, the writing instrument 2 in one embodiment is shown in an open position in a top plan view. According to this embodiment, the writing instrument 2 comprises two handles 20, and the longitudinal length $L_1$ of the writing utensil 4 is substantially coincident with the longitudinal length $L_2$ of the handle portions 20, thereby allowing the handle portions 20 to rotate about pins 30 positioned proximate to writing utensil distal end 8 and thereby enclose a substantial portion of the writing utensil 4. This geometric configuration allows the writing utensil 4 to be utilized in either an open position (as shown in FIG. 2), or a closed position (as shown in FIG. 3). Although as shown here in FIG. 2 the writing utensil 4 is slightly greater in length than the handle portions (i.e., $L_1>L_2$), in other embodiments the writing utensil 4 is fully enclosed by the handle portions 20 when the writing instrument 2 is in a closed position, as described in greater detail below.

One advantage of the ability to rotate the handles about the writing utensil is the enjoyment and entertainment a user may experience while holding the writing instrument and quickly positioning the handles in various positions and performing unique moves or tricks. This advantage is created by providing a connection between the handles and the writing utensil similar to a "butterfly knife," which has near frictionless connections between the blade and handles of the knife, and utilizes "balisong" style openings to allow the knife to be quickly and effortlessly positioned in a variety of different ways. A user may open and close the writing instrument in a variety of ways and in some instances employing a fair amount of dexterity depending on the skill of the user and their knowledge of the application of the balisong openings. Very skilled users may find enjoyment in very rapid manipulation of the handles, and may also be able to experiment with opening and deploying the writing utensil while only holding one of the handles and the other hanging free, for example.

Referring now to FIG. 3, the writing instrument 10 is shown in a front elevation view, with the two handles 20 positioned adjacent the longitudinal length of the writing utensil 4, thereby securing the writing utensil 4 within the recess of the handles 20, or otherwise in a stored or closed position. The handles 20 pivot about pins 30 and allow the handles 20 to rotate to a closed position as depicted in FIG. 3 or an open position (as depicted in FIG. 2). The writing utensil 4, according to this embodiment, is slightly longer in longitudinal length than the corresponding handles 20 when positioned in a closed position, thereby permitting a user to use the writing utensil 4 although the writing utensil 4 has been secured in a closed position. In an alternate embodiment, the handles 20 are longer in the longitudinal direction than the writing utensil 4 thereby preventing a user from utilizing the writing utensil 4 when the writing instrument 2 is in a closed position, and thereby protecting the writing utensil forward end 6 from damage when the handles 20 have been rotated to a closed position and the writing utensil 4 is secured between the handles 20.

The writing utensil 4 may be one of a variety of different styles, including but not limited to a pencil, a pen, such as a ballpoint or retractable ink pen, chalk, highlighter, felt tip or any other style of writing utensil which may be fit between two handles as described above. Furthermore, the writing utensil may be integrated with the contoured housing shown in FIG. 2 above, or may be designed to integrate with different shaped and sized housings to fit the users preferences.

Referring still to FIG. 3, the handles 20, according to one embodiment, are contoured to allow a user to grasp the writing instrument 2 at various points, depending on the user's preference and writing style. Although the handles 20 shown herein are defined shapes molded or fabricated from a rigid material, it is to be expressly understood that the handles may also comprise an additional layer for gripping of the handles by a user, such as a thermoplastic material, including but limited to rubber, plastic or other synthetic material encasing the rigid material of handles 20. As shown in FIG. 3, approximately three different contours 22, 24, 26 may be provided for grasping the writing instrument 2 with the handles 20 in a closed position. The contours provide multiple locations about the writing instrument 2 where a user may grasp a portion of the writing instrument 2 where the handles 20 narrow to a smaller dimension (taken about the minor or lateral axis of the writing instrument 2). It is to be expressly understood that fewer or greater number of contours 22, 24, 26 may be provided with handles 20 corresponding to the writing instrument 2 described herein, depending on the configuration of the handles 20 and the writing utensil 4.

Additionally, the handles 20 may further comprise latching means for fixing the handles 20 together when the writing instrument 2 is in an open or closed position. Latching means could include, by way of example but not limitation, magnetic strips located proximate to spacer element 46, with opposing polarities, thereby attracting one another when the spacer elements 46 of each handle 20 are in close proximity to one another and providing the necessary holding force to prevent the handles 20 from moving inadvertently during use of the writing instrument 2. Alternatively, the latching means could include a latch and corresponding hook, positioned on different handles 20 proximate to and one of the spacer elements 42, 44, 46. Once the latch engages the hook the handles 20 are prevented from rotating apart from one another, thereby fixing the handles in either an open or closed position. This may be accomplished when the handles are adjacent one another in either an open position or a closed position, as in either position the handles are positioned adjacent to one another, regardless of the latching means employed.

Figure 4:
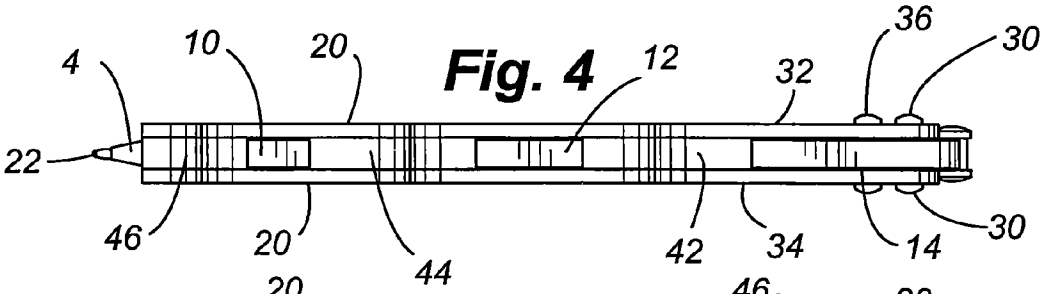
FIG. 4 is a top plan view of the writing instrument of FIG. 3.

Referring now to FIG. 4, the writing instrument 2 is shown in a closed position in a top plan view. The writing instrument 2, according to this embodiment, provides multiple locations for a user to grasp the writing instrument 2 directly, despite being secured between the corresponding handles 20 as shown in FIG. 4. The handles 20 at least partially enclose the writing utensil 4, however, allow exposure of multiple lateral surfaces 10, 12, 14 of the writing utensil 4 and permit a user to gain purchase of the writing utensil 4 and use the writing instrument 2 although the handles 20 are positioned about the writing utensil 4. A stopping pin 36 positioned proximate to the writing utensil distal end 8 prevents the handles 20 from rotating beyond a certain point, thereby preventing undue force on the writing utensil forward end 6 when the handles 20 are in a closed position.

Figure 6:
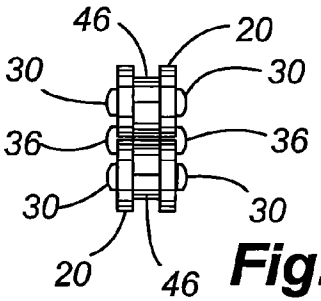
FIG. 6 is a rear elevation view of the writing instrument of FIG. 1.
Figure 5:
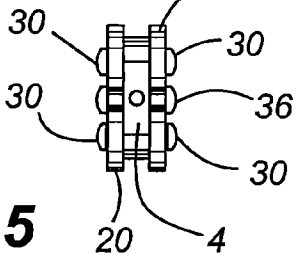
FIG. 5 is a forward elevation view of the writing instrument of FIG. 1.

Referring now to FIGS. 5 and 6, a writing instrument 2 according to one embodiment is shown in a forward elevation view and a rear elevation view with the writing instrument 2 in an open position of use. Referring specifically to FIG. 5, the writing utensil 4 extends forward in the longitudinal direction from the handles 20 which are positioned adjacent to the writing utensil 4 and connected thereto by pins 30 which permit the handles 20 to rotate about the writing utensil distal end 8. Referring to FIG. 6, a rear elevation view shows the ends of the handles 20 positioned adjacent to one another (viewed from the writing utensil distal end 8). This configuration permits the writing instrument 2 to be grasped either along the perimeter of the body of the writing utensil 4 or along the portion of the handles 20 that are exposed when in an open position of use.

Figure 8:
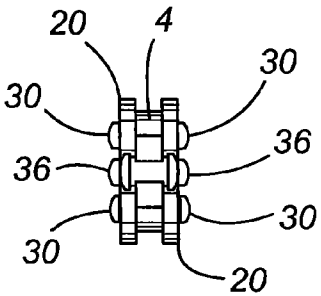
FIG. 8 is a rear elevation view of the writing instrument of FIG. 3.
Figure 7:
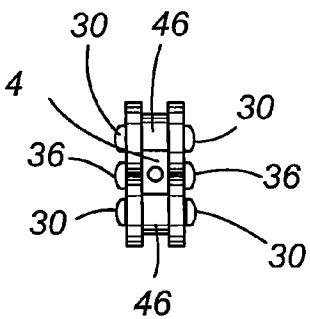
FIG. 7 is a forward elevation view of the writing instrument of FIG. 3.

Referring now to FIGS. 7 and 8, the writing instrument 2 is shown in a forward elevation view and a rear elevation view, respectively. As seen in FIG. 7, the writing utensil 4 fits securely between two recesses 48 formed by each of the corresponding handles 20, thereby preventing the writing utensil 4 from moving laterally within the body of the writing instrument 2 created by the handles 20 positioned adjacent the writing utensil 4 when the handles 20 are in a closed position.

Referring now to FIG. 8, a rear elevation view of the writing instrument 2 is shown in a closed position. Here, the handles 20 have been positioned about the writing utensil 4 so as to permit a user to store the writing instrument 2 in a pocket or sleeve or other compartment and thereby prevent the writing utensil 4 from being damaged.

Figure 9:
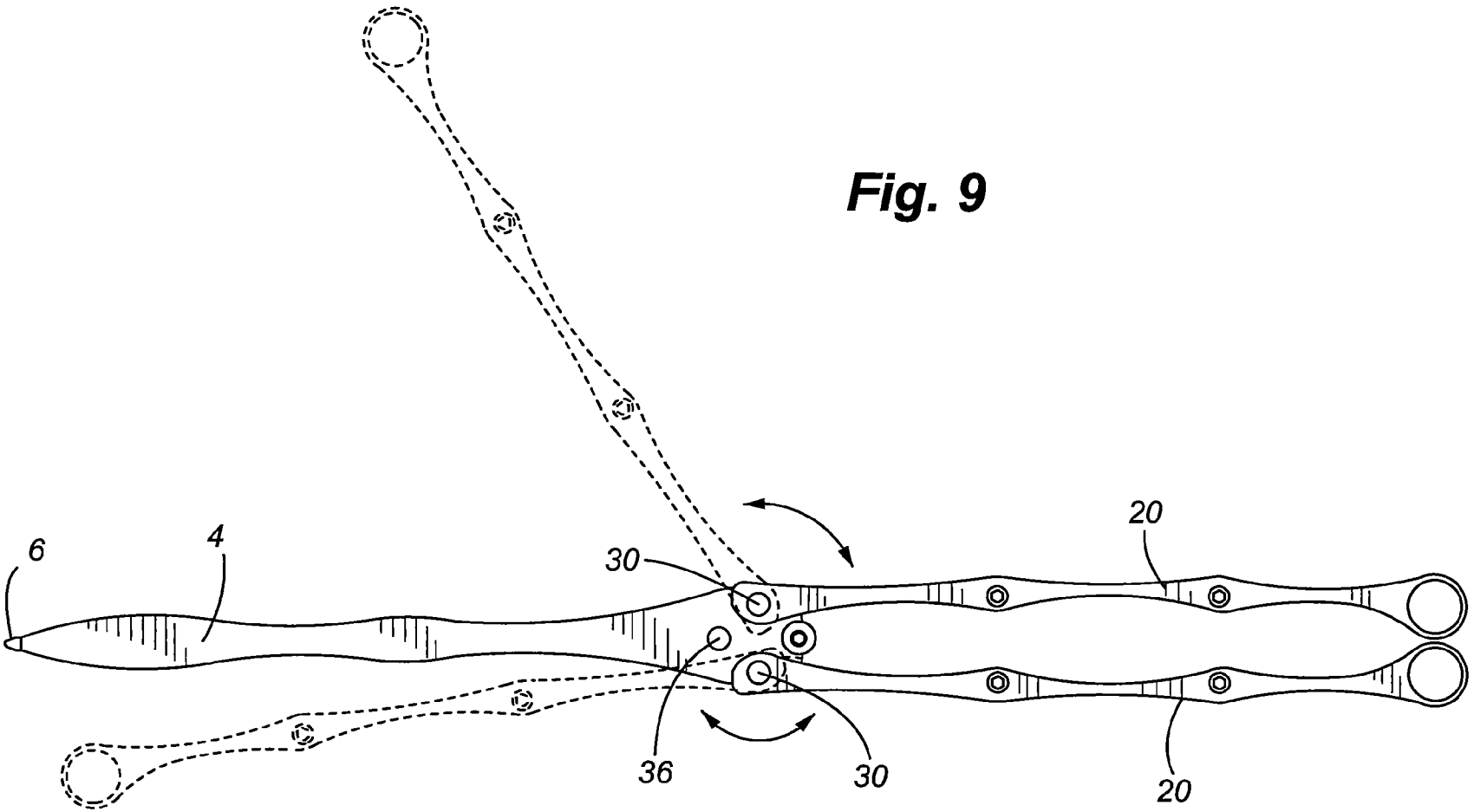
FIG. 9 is a front elevation view of the writing instrument of FIG. 1 depicting movement of the handles from an open position to a closed position.

Referring now to FIG. 9, the writing instrument 2 is shown in an open position of use with a ghosted image of the handles 20 being rotated about the pins 30, thereby demonstrating the action of converting the writing instrument 2 from an open position to a closed position. The handles 20 each rotate about an independent fixed point, shown here as pins 30, on the end of the writing utensil 4 opposite the writing utensil forward end 6, such that each handle 20 may rotate about the end of the writing utensil 4 and allow the writing utensil 4 to become partially enclosed between the two sides of each of the handles 20 as described in greater detail above. Although a writing instrument 2 according to the embodiment of FIG. 9 depicts the handle portions 20 slightly shorter in longitudinal dimension than the writing utensil 4, it is to be understood that the handles 20 may be longer than the writing utensil 4, thereby allowing the writing utensil 4 to become fully enclosed by the handles 20 when in a closed position.

Figures 10, 11:
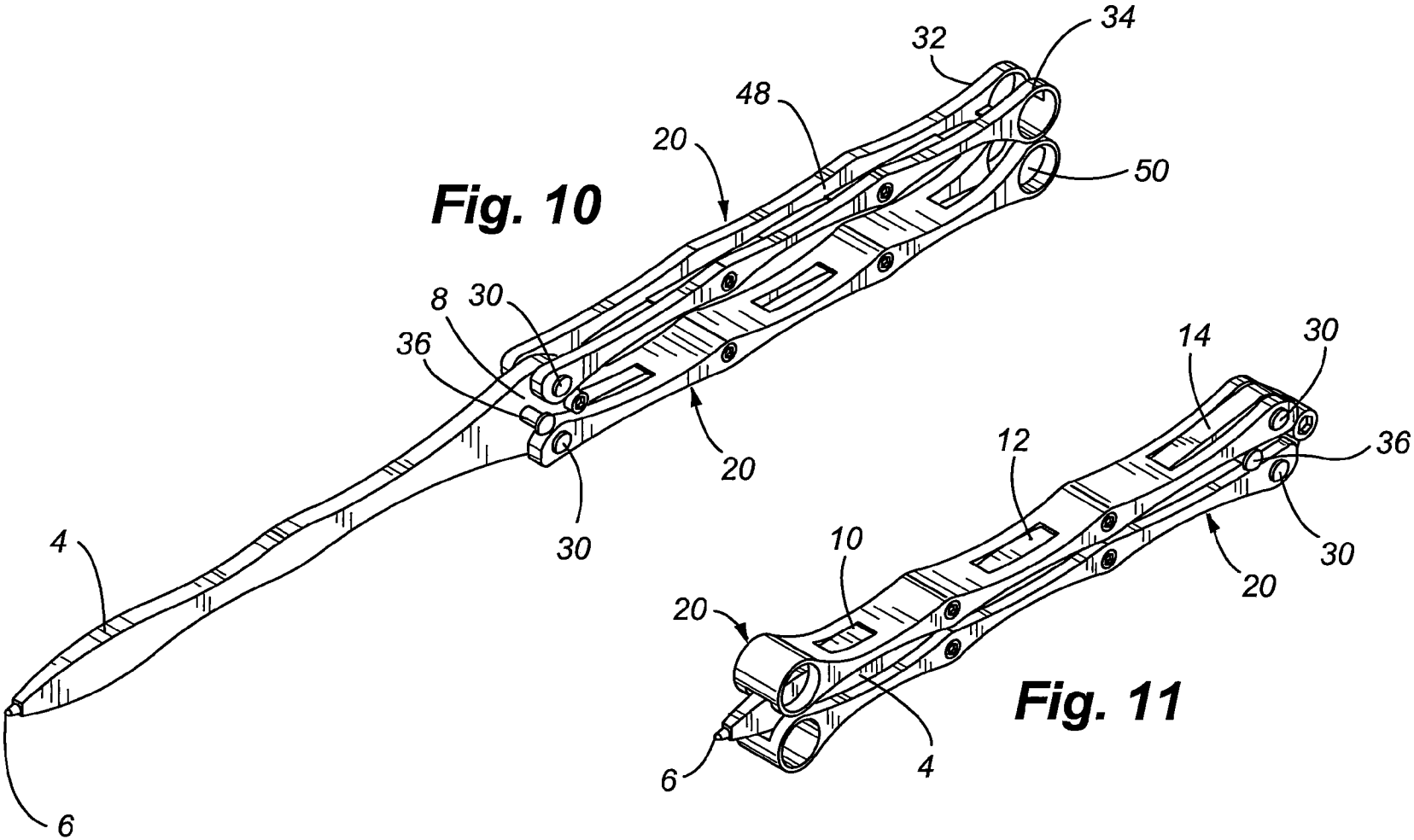
FIG. 10 is a front perspective view of the writing instrument of FIG. 1.
FIG. 11 is a front perspective view of the writing instrument of FIG. 3.

Referring now to FIG. 10, the writing instrument 2 of FIG. 1 is shown in a front perspective view. As seen here, each handle 20 is connected to the writing utensil 4 by a pin 30, thus creating a pivot point by which each of the handle 20 sections may rotate or pivot independently of one another and be positioned in either an open position of use, as shown in FIG. 10, or a closed position, as shown in FIG. 11. Each handle 20 comprises a first portion 32 and a second portion 34, spaced apart from one another by spacer elements 42, 44, 46, such that each handle 20 provides a recess 48 wherein the body of the writing utensil 4 may be stored when the handles 20 are in a closed position. Furthermore, each handle 20 comprises a hole or slot 50 at the rear end of each handle 20, for securing the handle 20 to a cord, chain, strap, or other device for securing the handle 20 to another article.

Referring now to FIG. 11, the writing instrument 2 is shown with the handles 20 in a closed position, thereby at least partially enclosing the writing utensil 4 and protecting the writing utensil 4 from damage while in a stored or closed position. The lateral surfaces 10, 12, 14 permit portions of the writing utensil 4 to be exposed, such that the writing utensil 4 may be grasped directly by a user when the writing instrument 2 is in a closed position, thereby facilitating use of the writing instrument 2 despite being in a closed position.

This positioning described above in reference to FIGS. 10-11 may be advantageous for several reasons. First, it may be desired to provide a writing instrument 2 that has both a small lateral dimension when in an open position, and a larger lateral dimension when in a closed position, thereby accommodating different preferences for a user when choosing the type of writing instrument 2 to use. Second, the position of the handles 20 partially enclosing the writing utensil 4 may provide a more rigid, stable and effective writing instrument 2 than the writing instrument 2 when the handles 20 are in an open position. Third, when the handles 20 are in a closed position, this greatly reduces the overall length of the writing instrument 2, thereby permitting the writing instrument 2 to be stored in a pocket, sleeve, or other opening or container for transporting and storing the writing instrument 2 and may also assist a user in grasping the writing instrument 2 and handling the writing instrument 2 with greater dexterity. Fourth, the writing instrument 2 may be stored in a closed position and thereby allow a user to protect the writing utensil 4 from damage while being transported.

For example, a writing instrument 2 according to one embodiment may be used by a individual who works in a harsh environment, thereby exposing the writing instrument 2 to several hazards which could potentially damage the writing instrument 2 when it is not in use. Therefore, by way of example but not limitation, the writing instrument 2 according to one embodiment may be stored in a closed position, such as in a toolbox or other container, where it may come into contact with other tools or equipment, and thereby be protected from damage when the handles 20 are positioned about the writing utensil 4 and partially enclosing the writing utensil 4. In this embodiment, the handles 20 may be comprised of a more durable or anti-corrosive material than the writing utensil 4, including but not limited to steel, stainless steel, aluminum, aluminum alloy, or other type of metal. In alternate embodiments, the handles 20 may be comprised of a lighter material such as a plastic-type material, which may further be advantageous in environments where the presence of metal objects on a person poses a hazard, such as an environment where there exists the potential for an electrical field to exist.

Figure 14:
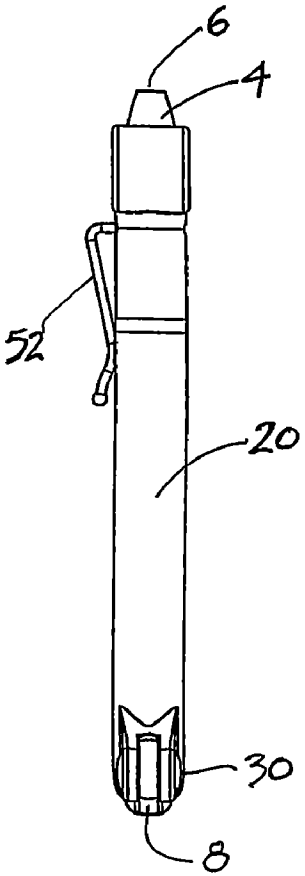
FIG. 14 is a top plan view of the foldable tool of FIG. 12.
Figure 13:
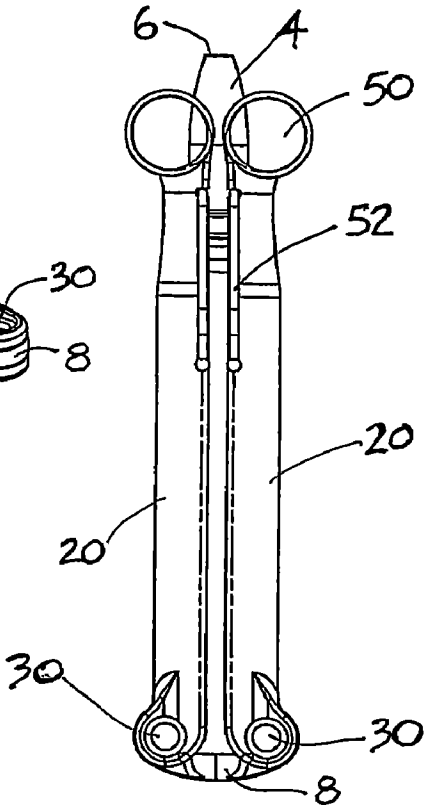
FIG. 13 is a front elevation view of the foldable tool of FIG. 12.
Figure 12:
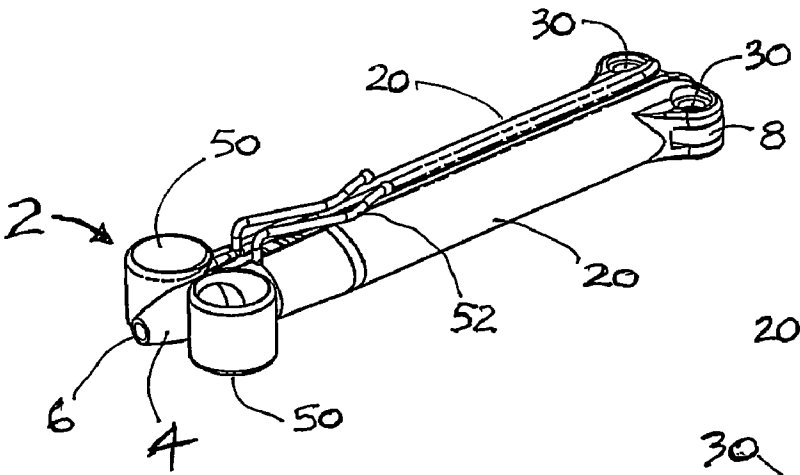
FIG. 12 is a front perspective view of a foldable tool according to an alternate embodiment of the invention.

A writing instrument 2 according to one alternate embodiment is shown in FIGS. 12-14. The writing instrument 2 is comprised generally of a first instrument such as a writing utensil 4 and a pair of handles 20 extending in a first position about the longitudinal axis of writing utensil 4, similar to the embodiments described above. However, the writing utensil 4 in this embodiment is near cylindrical throughout the length of the writing utensil 4 from the writing utensil forward end 6 to the writing utensil distal end 8. Each of the handles 20 is partially concave about the longitudinal axis of handles 20, thereby forming a recess for enclosing writing utensil 4 when the handles are in a closed position as shown in FIGS. 12-14. The handles 20 may rotate freely about the writing utensil distal end 8 about two pins 30 extending through the writing utensil 4 and coupling the handles 20 thereto, as described in greater detail above. The writing instrument 2 according to this embodiment further comprises a pair of slots 50 on each of the handles 20 for attaching the writing instrument 2 to another article by tying, looping or other fastening means, and also comprises a pair of clips 52 for attaching to an article.

According to various embodiments of the present disclosure, the writing instrument 2 may incorporate additional instruments, tools and/or devices without deviating from the novel aspects described herein. For example, the writing utensil 4 may be replaced or substituted with other instruments, such as a lead pencil, graphite pencil, mechanical pencil, mechanical eraser, pen, magic marker or eraser. Alternatively, nonwriting-style instruments may be substituted, including but not limited to a mini digital caliper, measuring wheel, ruler, including metric or standard, level, LED, laser pointer, flashlight, nail/pivot, pick, compass, divider/trammel point, scribe, or magnifier, telescope and/or a glow stick. Tables or references may further be provided in place of or in addition to the writing utensil 4, such as math tables (multiplication etc.), language tables, lists, including phone or emergency listings, cellular devices such as a cellular phone, a clock, a remote control, a tape recorder, mp3 player and/or a radio. Devices for personal use such as brushes, combs, files, including nail files, and/or other grooming tools may be incorporated. Other uses not described herein are contemplated for use as well. For example, containers such as a pill box, with partitions for varying size pills or to separate dosages may be provided.

According to yet another alternative embodiment, any one of the tools, instruments and/or devices described above may be substituted in place of either one of the handles at varying locations along the handles. By way of example, but not limitation, a nail or pivot may replace then generally curved handle end depicted in FIGS. 1-14, thereby allowing the device to serve as a fixed part on a writing or display surface, such as the pivot of a compass or sextant.

To provide further clarity to the detailed description provided herein in the associated drawings, the following list of components and associated numbering are provided as follows:

| Component No. | Component |
|---|---|
| 2 | Writing Instrument |
| 4 | Writing Utensil |
| 6 | Writing Utensil Forward End |
| 8 | Writing Utensil Distal End |
| 10, 12, 14 | Lateral Surfaces (of Writing Utensil) |
| 20 | Handles |
| 22, 24, 26 | Contours of Handles |
| 30 | Pin |
| 32 | First Portion (of Handle) |
| 34 | Second Portion (of Handle) |
| 36 | Stopping Pin |
| $L_1$ | Longitudinal Length (Writing Utensil) |
| $L_2$ | Longitudinal Length (Handles) |
| 42, 44, 46 | Spacer Elements (of Handles) |
| 48 | Recess (of Handles) |
| 50 | Holes/Slots (of Handles) |
| 52 | Clips |

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

As used herein, "at least one," "one or more," and "and/or" are open-ended expressions that are both conjunctive and disjunctive in operation.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the appended claims be construed to include alternative embodiments to the extent permitted by the prior art.

What is claimed is:

1. A foldable instrument comprising:

a writing utensil having a forward end and a distal end;

at least two handles each having a first end and a second end, said first end nearly frictionlessly rotatably interconnected to said distal end of said writing utensil, said at least two handles further comprising recesses along a longitudinal length of said at least two handles for enclosing at least a portion of said writing utensil between said at least two handles in a first position;

wherein said at least two handles are independently rotatable about said distal end of said writing utensil to allow said at least two handles to become positioned adjacent to each other in a second position with said writing utensil extended from said at least two handles in a position of use, wherein each of said at least two handles can independently rotate nearly frictionlessly around said point of interconnection at said distal end of said writing utensil, and wherein said at least two handles further comprise holes positioned proximate to second ends of said at least two handles which are adapted to permit selective manipulation of said at least two handles by a user.

2. The foldable instrument as claimed in claim 1, wherein said writing utensil is only partially enclosed by said at least two handles when said at least two handles are in said first position.

3. The foldable instrument as claimed in claim 1, wherein said at least two handles are nearly frictionlessly rotatably connected to said first distal end of said writing utensil about first ends of said at least two handles.

4. The foldable instrument as claimed in claim 3, wherein said at least two handles are substantially the same size and shape.

5. The foldable instrument as claimed in claim 1, wherein said writing utensil is selected from the group comprising at least one of a lead pencil, a graphite pencil, a mechanical pencil, a mechanical eraser, a pen, a magic marker and an eraser.

6. The foldable instrument as claimed in claim 1, wherein said foldable instrument is formed from a material comprising at least one of a plastic material, a synthetic material, a wood material, a bone material, a horn material, a stag material, a steel material, a stainless steel material, a brass material, an aluminum material, an aluminum alloy material, a composite material and a metallic material.

7. The foldable instrument as claimed in claim 1, wherein said writing utensil is comprised of a different material than said handles.

8. A foldable rotatable writing apparatus, comprising:

a first instrument having a forward end and a distal end, said forward end including a writing utensil;

at least two handles nearly frictionlessly rotatably interconnected to a fixed point on said first instrument, each of said at least two handles and said first instrument rotating within the same plane;

wherein either of said at least two handles further comprise a second instrument;

wherein said at least two handles are independently rotatable about said fixed point on said first instrument to allow said at least two handles to become positioned adjacent to each other with said first instrument extended from said at least two handles in a position of use, wherein each of said at least two handles can independently rotate nearly frictionlessly around said point of interconnection at said distal end of said first instrument, and wherein said at least two handles further comprise holes positioned proximate to a second end of said at least two handles which are adapted to permit selective manipulation of said at least two handles by a user.

9. The foldable tool as claimed in claim 8, wherein said at least two handles are rotatably connected to said fixed point on said first instrument about first ends of said at least two handles.

10. The foldable tool as claimed in claim 8, wherein said at least two handles further comprise a recess for selectively enclosing at least a portion of said first instrument.

11. The foldable tool as claimed in claim 10, wherein said first instrument may be used when said at least a portion of said first instrument is selectively enclosed in said recess.

12. The foldable tool as claimed in claim 8, wherein said at least two handles are interconnected to independent pivot points on said first instrument.

13. The foldable tool as claimed in claim 8, wherein said first instrument and said second instrument are selected from the group comprising at least one of a lead pencil, a graphite pencil, a mechanical pencil, a mechanical eraser, a pen, a magic marker, an eraser, a mini digital caliper, a measuring wheel, a ruler, a level, a LED, a laser pointer, a flashlight, a nail, a pivot, a pick, a compass, a divider, a trammel point, a scribe, a magnifier, a telescope, a glow stick, a reference device, a math table, a language table, a list, a cellular device, a paging device, a clock, a remote control, a tape recorder, a mp3 player, a radio, a brush, a comb, a file and a container.

14. The foldable tool as claimed in claim 8, wherein said foldable tool is formed from a material comprising at least one of a plastic material, a synthetic material, a wood material, a bone material, a horn material, a stag material, a steel material, a stainless steel material, a brass material, an aluminum material, an aluminum alloy material, a composite material and a metallic material.

15. The foldable tool as claimed in claim 8, wherein said first instrument is comprised of a different material than said at least two handles.

16. The foldable instrument as claimed in claim 1, wherein said at least two handles are interconnected to said distal end of said writing utensil at independent pivot points.

17. The foldable instrument as claimed in claim 1, wherein said at least two handles rotate within the same plane.

18. A foldable instrument comprising:

a writing utensil having a forward end and a distal end, said forward end including a writing tip;

at least two handles, a first end of each of said handles rotatably interconnected to said writing utensil proximate to said distal end of said writing utensil;

said at least two handles further comprising recesses along a longitudinal length of said at least two handles for selectively enclosing at least a portion of said writing utensil between said at least two handles in a first position;

wherein said at least two handles further comprise holes proximate to second ends of said at least two handles adapted to permit selective manipulation of said at least two handles by said hand of said user; and wherein said at least two handles are nearly frictionlessly connected to said writing utensil by independent hinge pins to allow said at least two handles to independently rotate about said first distal end of said writing utensil and to further allow said at least two handles to be rotated relative to said writing utensil in a variety of positions, including said first position proximate to said forward end of said writing utensil and a second position behind said distal end of said writing utensil.

19. The foldable instrument as claimed in claim 18, wherein said at least two handles further comprising multiple contours along at least one surface of said at least two handles for grasping by a hand of a user.

* * * * *